US005096354A

United States Patent [19]

Wu

[11] Patent Number: 5,096,354

[45] Date of Patent: Mar. 17, 1992

[54] APPARATUS FOR RECEIVING AND/OR DELIVERING ARTICLES

[76] Inventor: Chin-Sheng Wu, P.O. Box 10780, Taipei, Taiwan

[21] Appl. No.: 371,540

[22] Filed: Jun. 26, 1989

[51] Int. Cl.[5] ..... B66D 9/10

[52] U.S. Cl. ..... 414/265; 414/337; 414/338; 414/389; 414/401; 414/402; 414/573; 414/584; 414/609

[58] Field of Search ..... 414/265, 337, 338, 373, 414/374, 389, 401, 402, 573, 584, 585, 609

[56] References Cited

U.S. PATENT DOCUMENTS

| | | | |
|---|---|---|---|
| 1,430,515 | 5/1922 | Poston et al. | 414/265 |
| 1,833,556 | 11/1931 | Bennington | 414/373 |
| 2,044,592 | 6/1936 | Richards | 414/338 X |
| 2,195,544 | 4/1940 | Stahl et al. | 414/337 X |
| 2,290,844 | 7/1942 | Smith | 414/389 X |
| 2,451,226 | 10/1948 | Kemp, Jr. | 414/401 X |
| 2,828,027 | 3/1958 | Stevenson et al. | 414/401 X |
| 3,115,975 | 12/1963 | Thompson | 414/373 X |
| 3,534,876 | 10/1970 | Bornstein et al. | 414/373 X |
| 3,902,427 | 9/1975 | Kastenbein | 414/609 X |
| 4,566,841 | 1/1986 | Ohmura et al. | 414/609 X |
| 4,697,974 | 10/1987 | Eltoukhy | 414/401 X |

FOREIGN PATENT DOCUMENTS

| | | | |
|---|---|---|---|
| 779234 | 11/1980 | U.S.S.R. | 414/609 |
| 1046166 | 10/1983 | U.S.S.R. | 414/337 |

*Primary Examiner*—David A. Bucci
*Assistant Examiner*—Robert S. Katz

[57] ABSTRACT

Apparatus for receiving and/or delivering articles comprises a generally horizontal conveyor having a number of cars arranged to travel along it. A receiving station and a delivering station are located in the path of travel of the cars along the conveyor. Each car has doors at its ends which are normally kept closed but which are arranged to open as the car approaches the receiving end delivering stations and to close on leaving the stations. The receiving station has a plate located below the base of the car but engageable therewith and means are provided to retain articles in the car on the plate as the car passes through the receiving station. The delivering station has a similar plate located below the base of the car but engageable therewith and a mechanism is provided to retain articles on the plate until the car passes through the delivering station when it picks up the articles from the plate automatically. The plate of the receiving station and the plate of the delivering station are mounted on respective vertical elevator frameworks and each can be moved between a first position in which it is engageable with the base of a car and a second position in which it is located above or within a respective drawer at the base of the associated elevator framework.

21 Claims, 13 Drawing Sheets

APPARATUS FOR RECEIVING AND/OR DELIVERING ARTICLES

FIELD OF THE INVENTION

This invention relates to apparatus for receiving and or delivering articles, in particular documents, utilising a conveyor system.

BACKGROUND OF THE INVENTION

In large building complexes such as hospitals or offices, it is frequently necessary to transfer documents and other articles from one department to another and delays are often experienced in the transfer of such articles. An easily seen example of this is a polyclinic. The conventional operating procedure is that after a patient has registered, he or she must wait outside the doctor's consultation room for examination while, in the meantime, staff at registration desk pass the patient's file to the doctor. The patient therefore has to wait for a long time before examination. Similarly, if it is necessary for an inspection to be made during diagnosis, much time is wasted waiting for the inspection report. Similar delays can occur when sending a prescription to the medicine room for medicines and when returning files to the file room. The transmission of documents between the various departments is time consuming and if performed manually takes up a lot of man hours decreasing efficiency and increasing operating costs of the hospital, business or other enterprise.

It has previously been proposed to improve productivity through the use of a pneumatic conveyor system for the transfer of documents and like articles between departments. However, with such a system, the documents have to be scrolled and put into a small cylindrical container and thich and hard documents cannot be scrolled for this purpose so that this system is not popular.

A further system has been proposed utilising a conveyor system which imitates a railway system and in which a conveyor rail is mounted on the ceiling of a building and along which cars for delivering documents are arranged to run. On receiving a predetermined signal, a car is arranged to travel along the conveyor rail to a certain station at which staff can take documents or other articles out of the car or put documents or other articles into the car. The car will then continue to travel along the conveyor rail to another station. Although this system overcomes the drawbacks of the pneumatic conveyor system, it still wastes a lot of space because the conveyor rail must descend from the ceilings to the stations and ascend from the stations back to the ceilings. Further, if the staff at any particular station forget to take out of or put into the car documents or other articles and leave the car unable to take instructions, following cars will be unable to enter that station and the whole system will be stopped.

OBJECT OF THE INVENTION

The present invention aims to provide a conveyor system in which car jamming can be avoided by ensuring that cars cannot be retained indefinitely at any particular station.

A further aim is to provide a conveyor system in which ascending and descending portions of the conveyor rail to the stations can be eliminated or at least substantially reduced in order to save space.

SUMMARY OF THE INVENTION

According to the invention, there is provided apparatus for receiving and/or delivering articles comprising a generally horizontal conveyor having at least one car arranged to travel therealong and receiving and/or delivering station located in the path of travel of said car, said station having a plate for receiving articles and provided with a groove and the car having on its base a channel engageable in said groove, means being provided to ensure that articles are transferred from the car to the station or from the station to the car automatically during the passage of the car through the station.

If the station is a receiving station, the plate is desirably located below the base of the car, a stopper being located in the groove in said plate and retained therein by retractable locking components, the stopper having an upwardly projecting frame located above the base of the car for retaining articles carried by the car and the locking components being spaced apart by a distance greater than the length of the car thereby, during passage of the car through the receiving station, a first pair of locking components are released by the channel of the base of the car through the groove and subsequentlt re-engage before a second pair of locking components are released by the said channel, the stopper being arranged to pass through the channel as the car passes through the receiving station.

Preferably, the lockable components on the stopper are engaged in respective slots in the side walls of the groove in said plate of the receiving station and the plate of the receiving station is desirably provided with further grooves adapted to receive ribs provided on the base of the car.

According to a preferred embodiment of the invention, the plate of the receiving station is pivotally mounted on a frame which is mounted for vertical movement on an elevator framework whereby said plate can be raised into a first position in which it is engageable with the base of the car and lowered into a second position in which it is arranged to deposite articles thereon into a drawer or the like located below the plate. The means for depositing articles preferably comprise a standard mounted on the elevator framework and engageable with the plate as the latter is lowered to cause the plate to pivot and allow articles thereon to slide off.

If the station is a delivering station, the plate is desirably also located below the base of the car, a stopper plate being pivotally mounted at the rear end of the plate, said stopper plate being normally substantially vertical and arranged to hold articles on the first-mentioned plate until the leading end of the car makes contact with the stopper plate to force it down after said articles have been picked up by the base of the car.

Preferably, the stopper plate is normally held in the substantially vertical position by a hook which is arranged to be disengaged by the channel on the base of the car as said channel travels along the groove in the plate of the delivering station.

The plate in the delivering station is preferably provided with side walls which are pivotally connected to the plate by links and which are arranged to be depressed in a substantially vertical direction by the base of the car during passage of said car through the delivering station.

According to a preferred embodiment of the invention, the plate of the delivering station is mounted for vertical movement on an elevator framework whereby the plate can be raised into a first position in which it is engageable with the base of the car and lowered into a second position in which it is arranged to receive articles to be delivered to the car when the plate is in the raised position. The plate is desirably provided with a board slidably mounted in the plate, said board being normally retained substantially within the plate by locking means arranged to be released when the plate is in said second position whereby the board can then be slid at least partially out of the plate.

A drawer may be provided substantially at the base of the elevator framework of the delivering station, the drawer being adapted to receive the plate in the second lower position thereof.

The apparatus according to the present invention preferably has both a receiving station and a delivering station.

The car is desirably provided at its front and rear ends with respective doors, means being provided for opening the doors before the car enters the receiving and/or delivering station and for closing the doors after the car leaves the receiving and/or delivering station. Each door is desirably mounted at or adjacent to the top of the respective end of the car.

According to a preferred embodiment of the invention, the car comprises an upper part arranged to travel on the conveyor and housing drive means for the car and a lower part comprising a chamber arranged to hold articles for delivery to the receiving station and/or collection from the delivering station.

Preferably, the conveyor is provided with a toothed rack and the drive means of the car includes a pinion engageable with the rack of the conveyor.

The conveyor may further have portions which are inclined to the horizontal, said portions being provided with a second toothed rack and the drive means of the car including a second pinion engageable with the said second toothed rack.

Utilising the apparatus according to the invention, the conveyor system can be kept generally horizontal. When it is necessary for an ascending/descending conveyor to exist between floors, receiving and delivering stations can be provided which are connected to the conveyor and extend substantially vertically. A plurality of cars can be mounted on the conveyor with automaic door opening and closing means arranged to operate as the cars approach and leave the receiving-/delivering stations.

DETAIL DESCRIPTION OF THE PREFERRED EMBODIMENT

Figure 1:
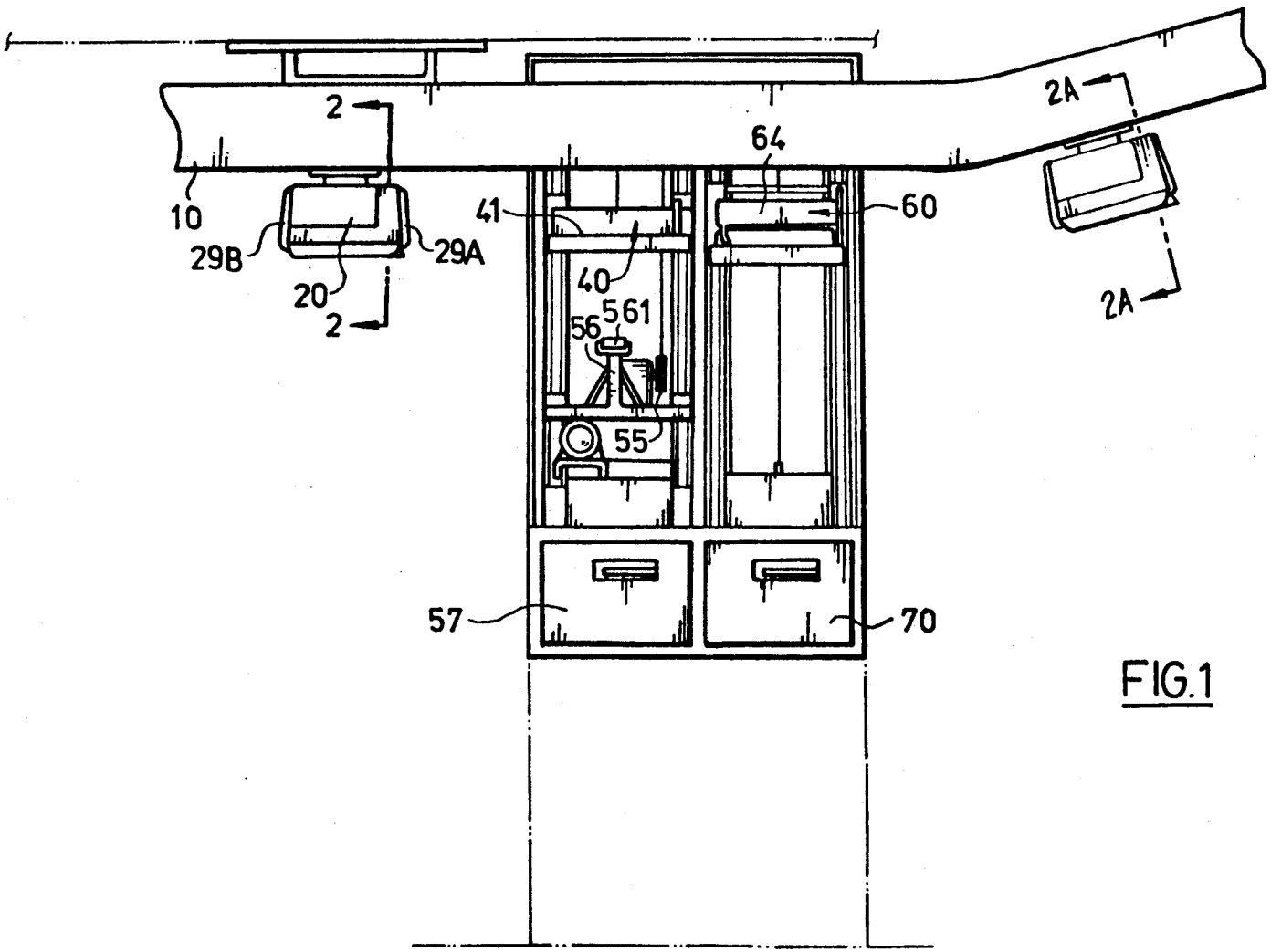
FIG. 1 is a front view of one embodiment of an apparatus for receiving and delivering articles according to the invention.
Figure 2:
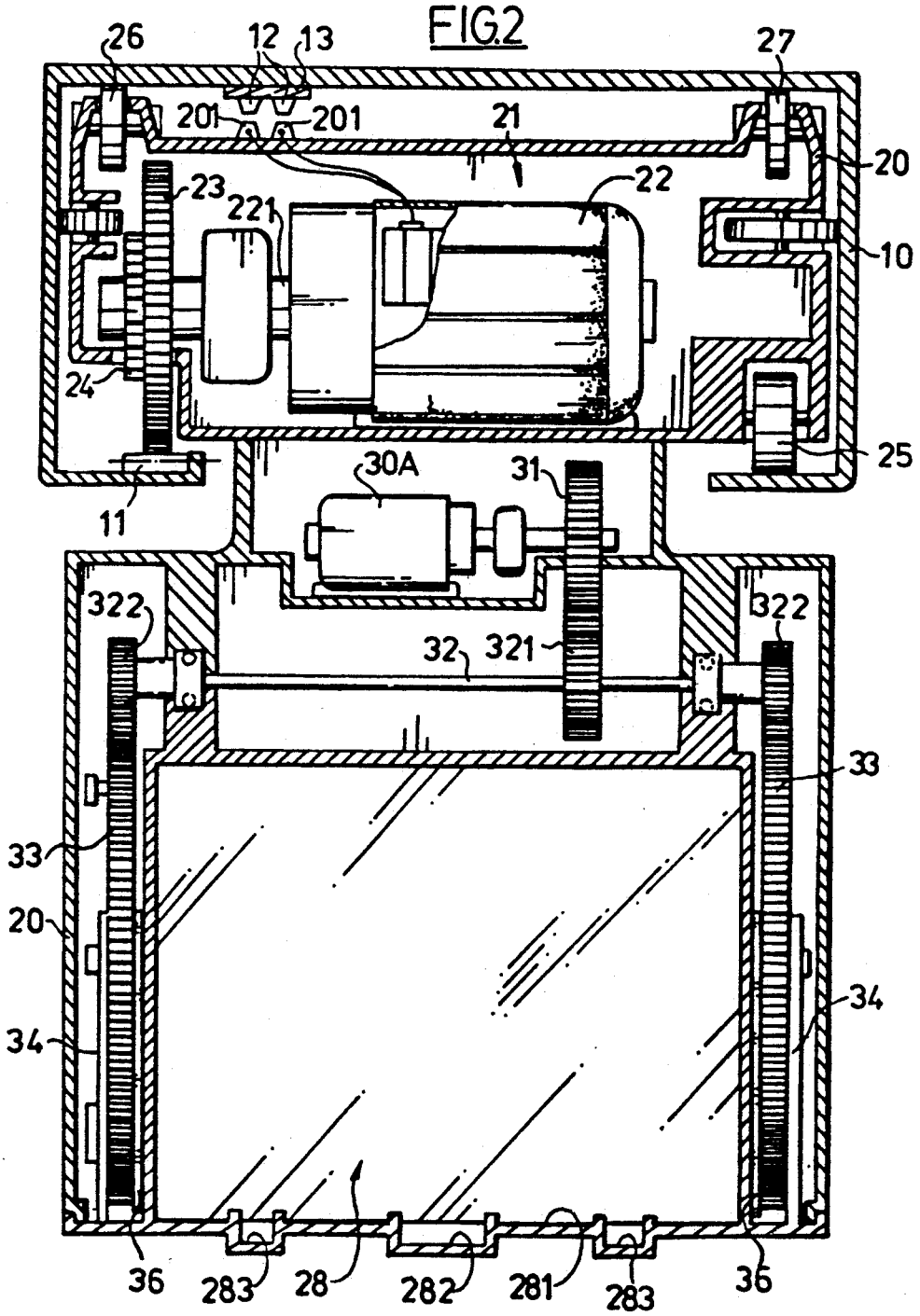
FIG. 2 is a section taken on the line 2—2 in FIG. 1 in the direction of the arrows.

Reference will first be made to FIGS. 1 and 2 of the drawings in which a generally horizontally extending conveyor rail 10 which is open at the bottom as can be seen from FIG. 2, is provided on a bottom side flange with a toothed rack 11 and on the lower surface of its upper part with a pair of electric conductors 12 which are connected to an electricity supply service and which are separated from the conveyor rail 10 by a strip 13 of electrically insulating material.

A car 20 is adapted to be suspended from and to be conveyed along the conveyor rail 10. The car has an upper part 21 in the form of a casing which is adapted to be received within the conveyor rail 10. A motor 22 is located in the upper casing part and is arranged to drive a pinion 23 by means of an output drive shaft 221, the pinion 23 being in engagement with the rack 11. A further, smaller, pinion 24 is also mounted on the drive shaft 221 and is arranged to engage with a toothed rack 11A on an inclined part of the conveyor rail 10 (see FIG. 2A). The speed of the car 20 will thus be lower on inclined parts of the conveyor rail but a more positive and easier ascent will be achieved.

Figure 2A:
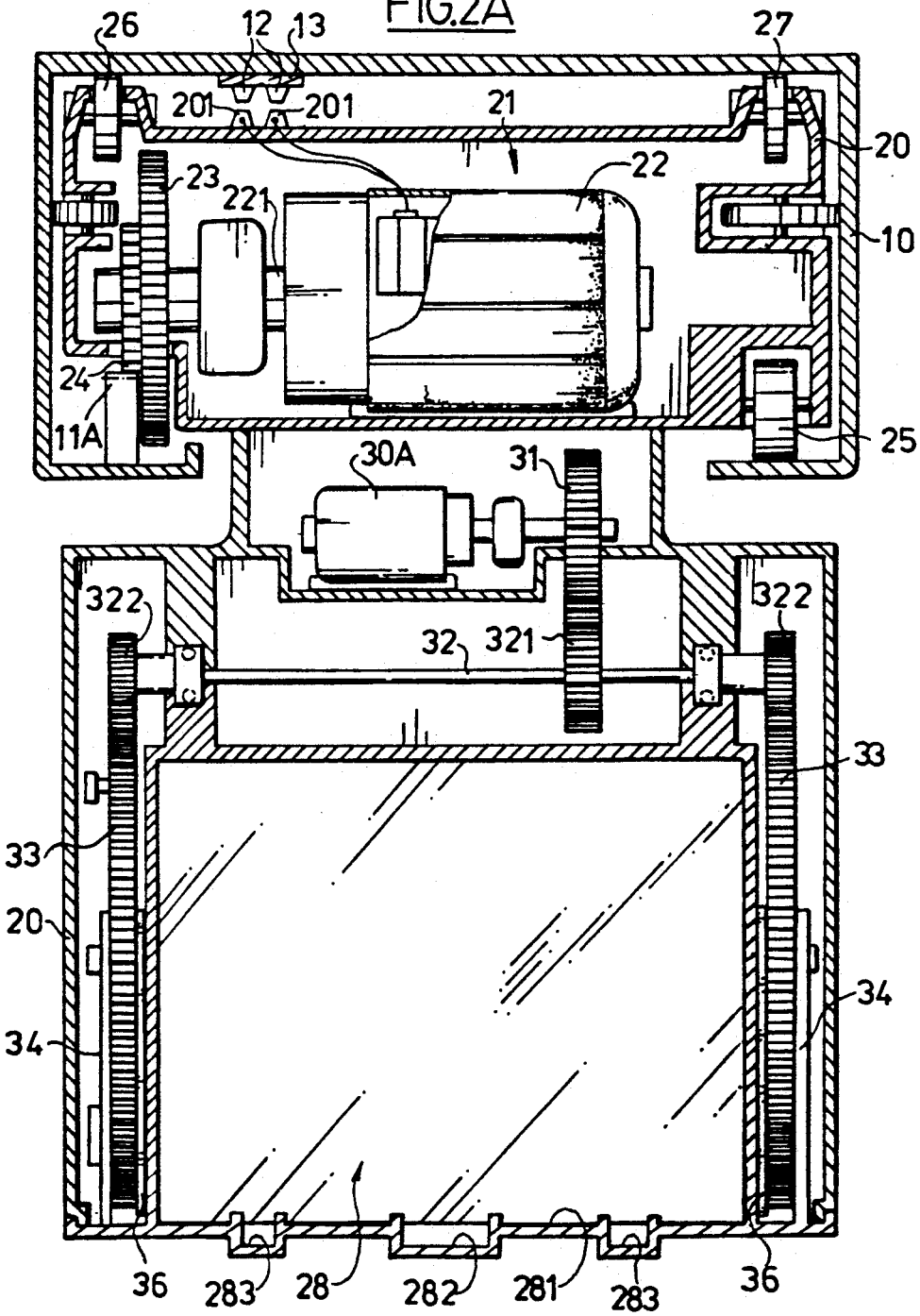
FIG. 2A is a section taken on the line 2A—2A in FIG. 1 in the direction of the arrows.

As can be seen from FIGS. 2 and 2A, the pinions 23 and 24 are located at one side of the upper part casing 21 of the car 20, which pinions are engageable, respectively, with the toothed racks 11 and 11A. The other side of the upper part casing 21 is provided with a roller 25 which is arranged to run on the other bottom side flange of the conveyor rail 10. Further rollers 26 and 27 are provided on the top of the casing part 21 and are arranged to run along the lower surface of the upper part of the conveyor rail 10. Current collectors 201 are also provided on the top of the upper part casing 21 for co-operation with the conductors 12 and the current collectors are connected to the electric motor 22.

A lower chamber 28 is connected to the upper part casing 21 of the car and is suspended below the conveyor rail 10. The chamber 28 has a base plate 281 and a door 29A and 29B at each end. Control means are provided for ensuring that both doors are kept closed when the car 20 is actually moving along the conveyor rail 10. These control means comprise electric motors 30A and 30B which are mounted on the top of the lower part of the car 20 and which are provided with electric connections (not shown) to the current collectors 201.

Figure 3:
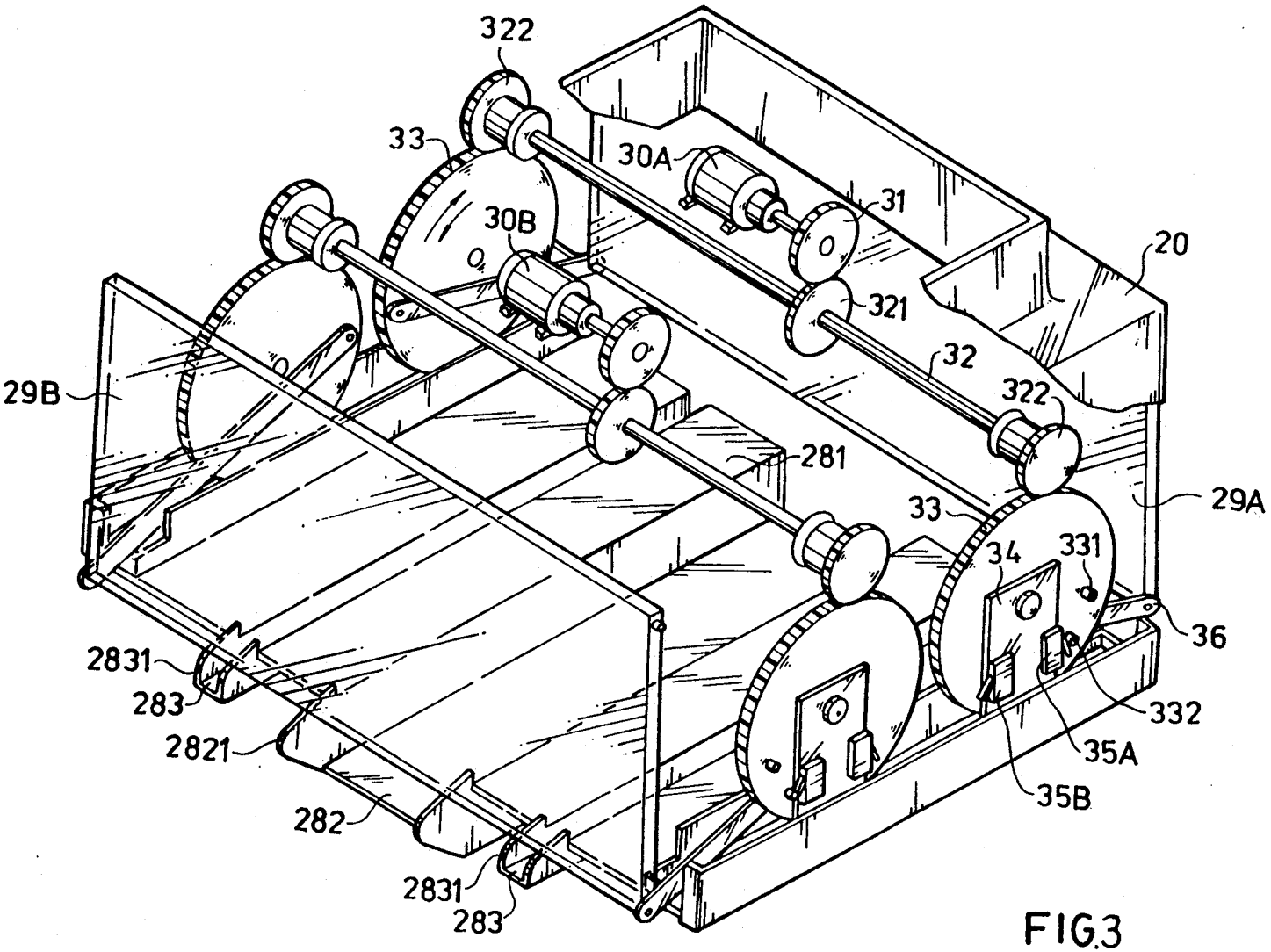
FIG. 3 is a perspective view of the upper part of the car shown in FIG. 1, 2 and 2A and illustrating the door opening and closing mechanism.

As shown in FIG. 3, a main gear 31 is mounted on the drive output shaft of the motor 30A and engages a following pinion 321 on a shaft 32 mounted in bearings in the car 20 and provided at each end with a driving pinion 322. Each pinion 322 engages a respective pinion 33 rotatably mounted on a respective plate 34 one of which is provided at each side edge with respective limit switches 35A and 35B. One of the pinions 33 is provided on a side face with knobs or projections 332 and 331 arranged to engage with, respectively, the micro-switches 35A and 35B. The micro-switches are connected to a control box for controlling the direction of rotation of the motor 30A and the switches are arranged, when contacted by a respective projection 332 or 331, to stop the motor.

Figure 4A:
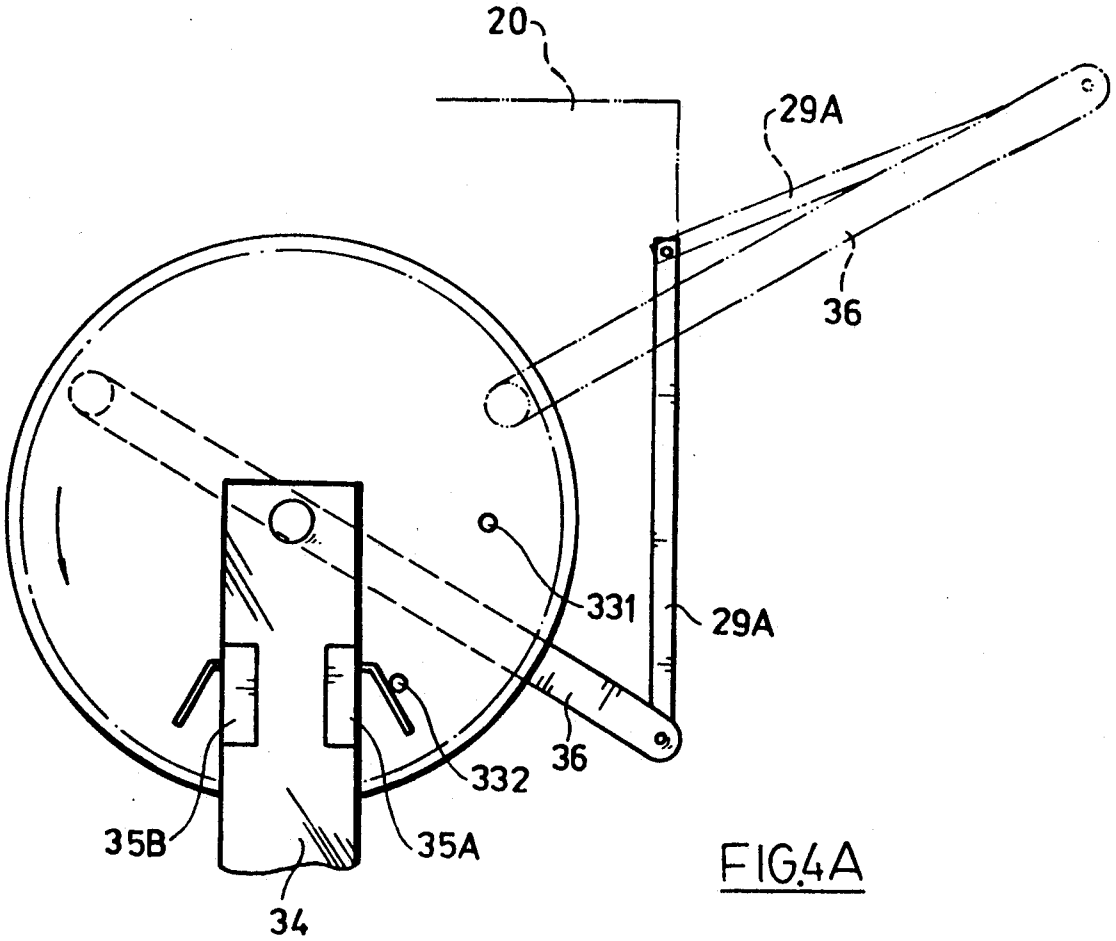
FIGS. 4A, 4B and 4C are side elevations showing various stages in the sequence of opening and closing of a door of the car.
Figure 4B:
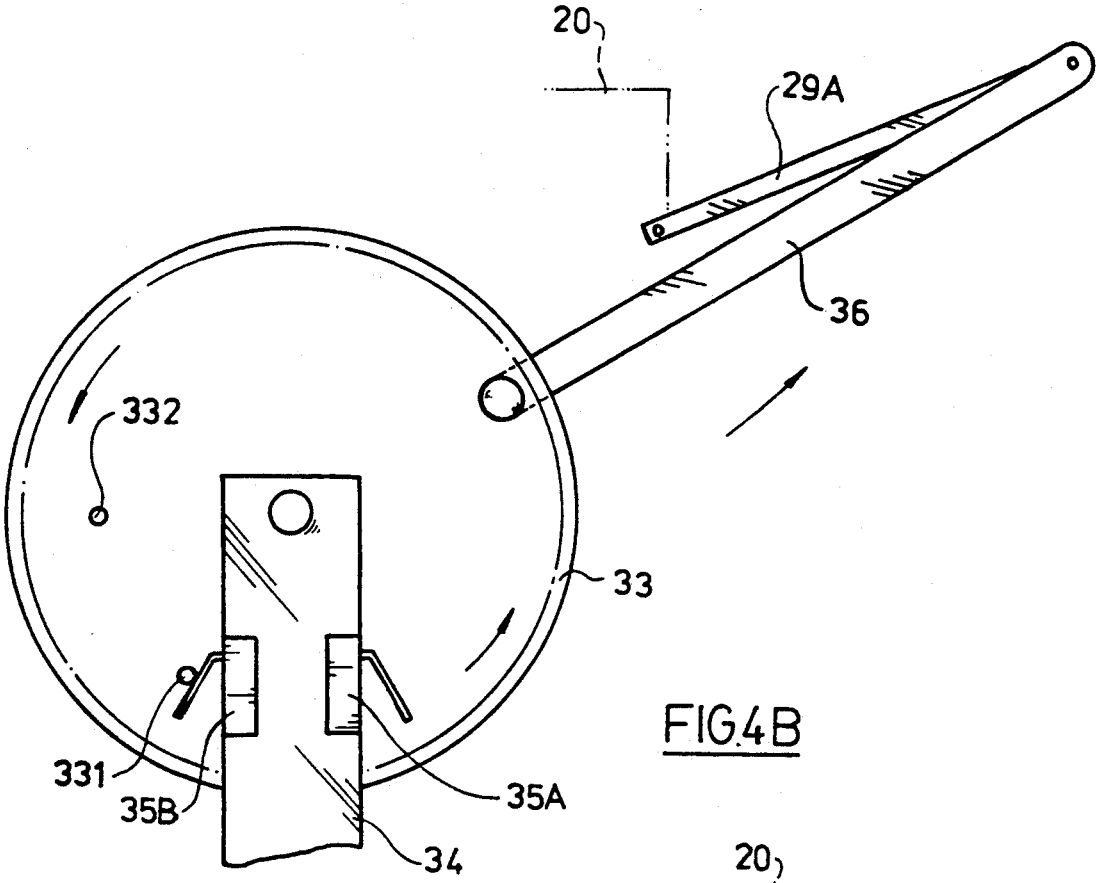
Figure 4C:
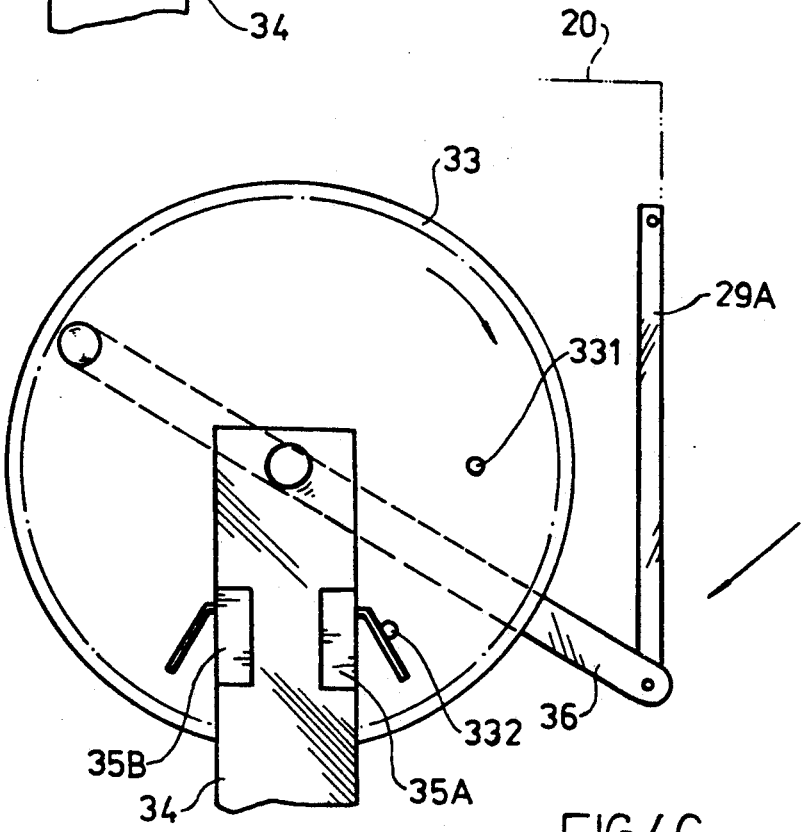

A lever 36 is pivotally mounted, at one end, on each pinion 33 and the other end of each lever is pivotally connected to the lower end of the door 29A which is pivotally mounted at its upper end on the chamber 28 of the car 20. In the position shown in FIG. 3 and in full lines in FIG. 4A, the door 29A is in the closed position. If the motor 30A is now driven to drive the pinions 33 in an anti-clockwise direction as indicated by the curved arrows in FIGS. 4A and 4B, the levers 36 are moved to the position shown in FIG. 4B and in dotted lines in FIG. 4A so that the door 29A is moved to the fully open position. In this position, the projection 331 on said one of the pinions 33 engages the micro-switch 35B to stop the motor 30A. If the motor 30A is now driven in the opposite direction, the pinions 33 are driven in a clockwise direction, as indicated by the curved arrow in FIG. 4C, and the levers 36 are moved back to the position shown in full lines in FIG. 4A and in FIG. 4C in which the door 29A is in the fully closed position. In this position, the projection 332 on said one of the pinions 33 engages the micro-switch 35A to stop the motor 30A.

The other door 29B is operated in a similar manner by the motor 30B. The doors are arranged to be opened just before the car 20 reaches a station at which receiving apparatus and delivering apparatus are located and to be closed shortly after leaving the station.

The apparatus for picking up articles to be delivered to the chamber 28 of the car will now be described with reference to FIGS. 5 to 9 and comprises a receiving apparatus 40 having a base plate 41. The plate 41 is arranged to be located at a level below the base plate 281 of the chamber 28 and has a central groove 411. A stopper 42 is located in the groove 411 and is maintained in position by having locking components or projections 422 and 424 in its side walls adjacent each end which are engaged, respectively, in slots or apertures 412 and 413 in the side walls of the groove 411. The stopper 42 is further provided with a tapered leading end 421 and with an upwardly projecting frame 423 slightly in front of the locking components or projections 424 and which is higher than the base plate 281 of the chamber 28 so that said frame is effective to stop articles carried in the car 20.

Figure 8A:
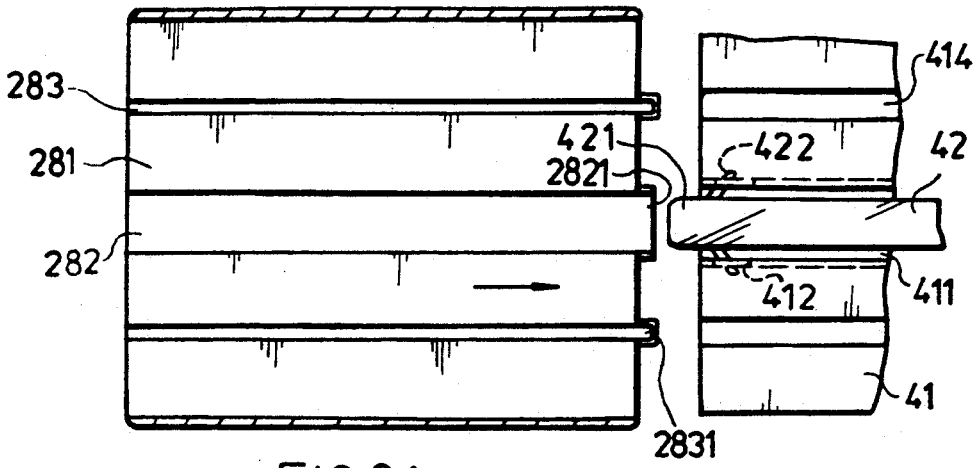
FIGS. 8A, 8B and 8C are plan views illustrating sequential steps during the passage of the car through the receiving apparatus shown in FIG. 7.
Figure 8B:
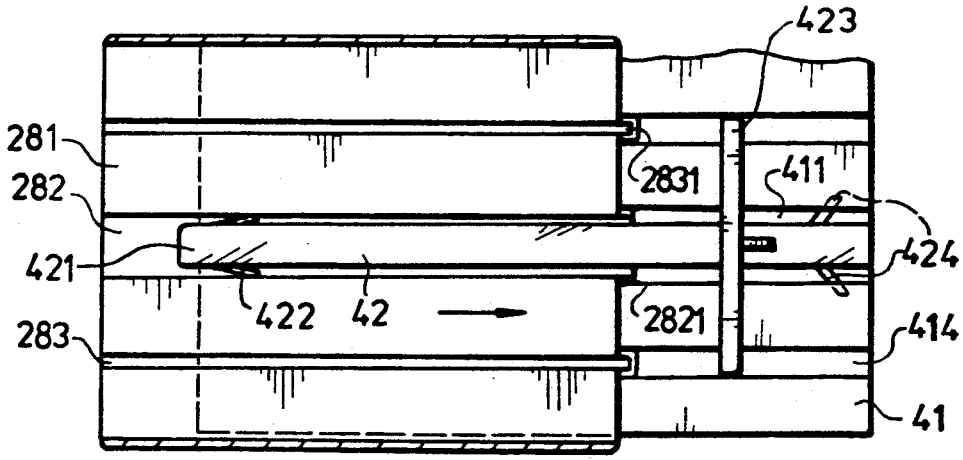
Figure 8C:
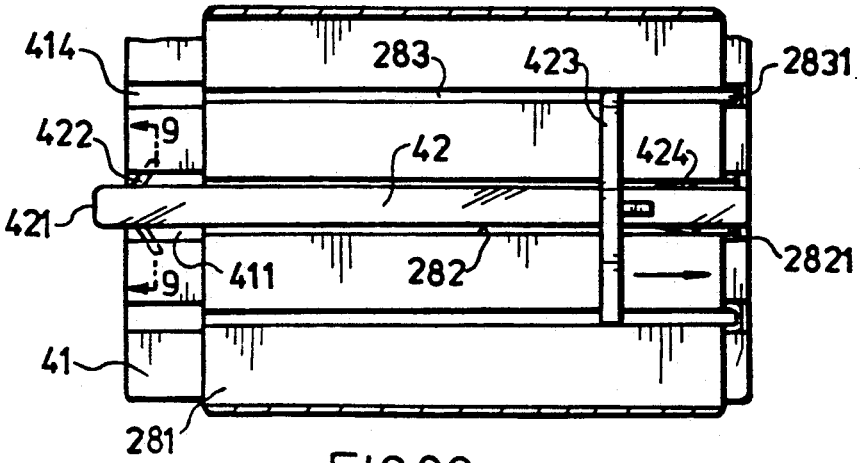
Figure 10:
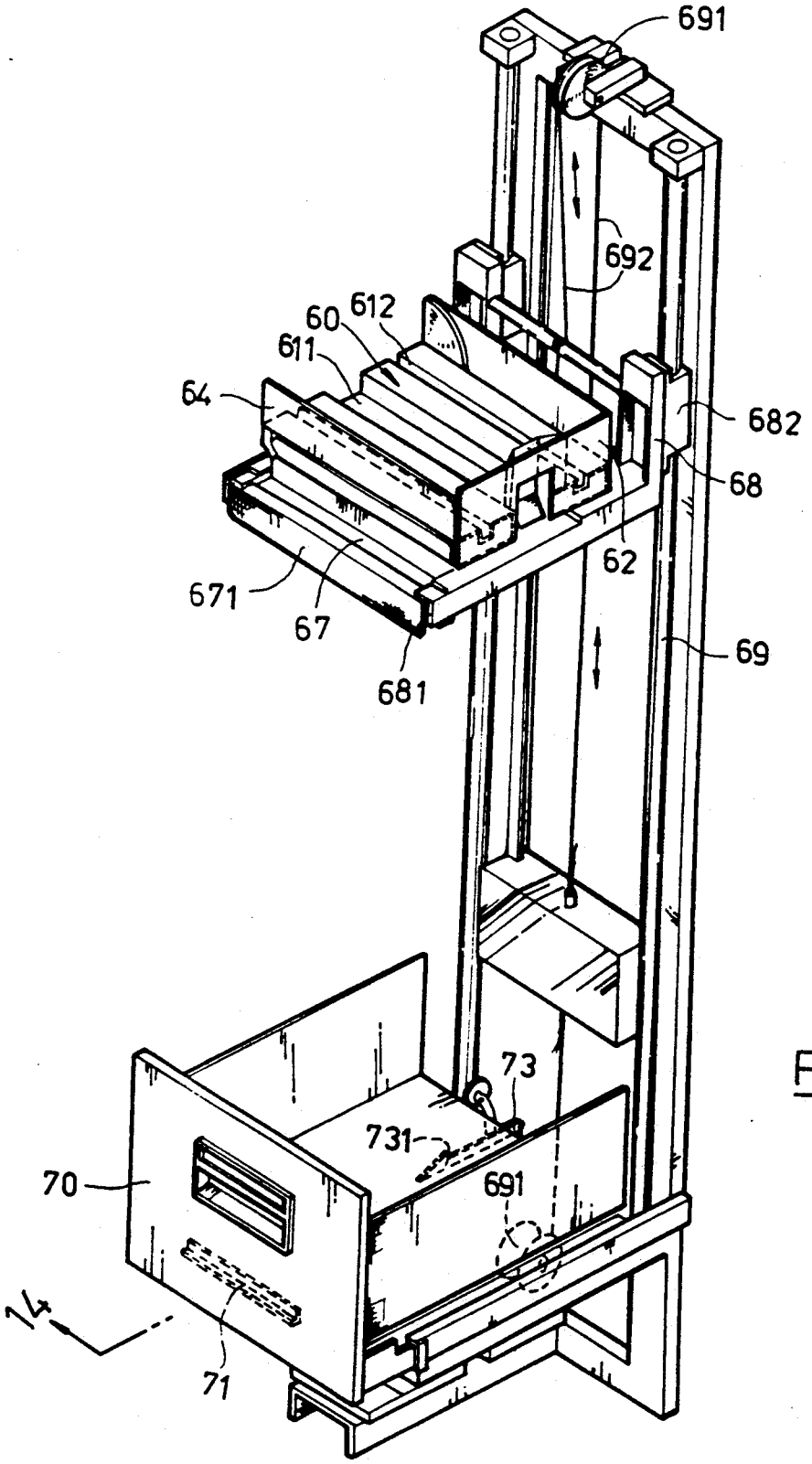
FIG. 10 is a perspective view of the delivering station forming part of the apparatus shown in FIG. 5.

Two smaller guide grooves 414 are also provided in the plate 41, one on either side of the central groove 411, for receiving ribs 283 on the underneath surface of the base plate 281 for the purpose of guiding the car 20 through the receiving apparatus 40. A further U-section channel 282 is provided in the central region of the base plate 281 which channel is receivable in the central groove 411 in the plate 41. The side walls of the stopper 42 are spaced from the side walls of the groove 411 to permit the side walls of the channel 282 to pass between them, the locking components or projections 422 and 424 be retractable for this purpose. As shown in FIGS. 8A, 8B and 8C, as the car 20 passes through the receiving apparatus 40, the side walls of the channel 282 will first engage the projections 422 and push them out of the slots 412. However, the distance between the locking components or projections 422 and 424 is greater than the length of the channel 282 so that the projections 422 will move back into engagement in the slots 412 before the sides of the channel 282 move the projections 424 out of the slots 413. In this manner, the stopper 42 is reliably retained in the central groove 411 and any articles in the chamber 28 will be engaged by the frame 423 and retained on the base plate 41 of the receiving apparatus 40 as the car moves through the receiving apparatus.

Figure 5:
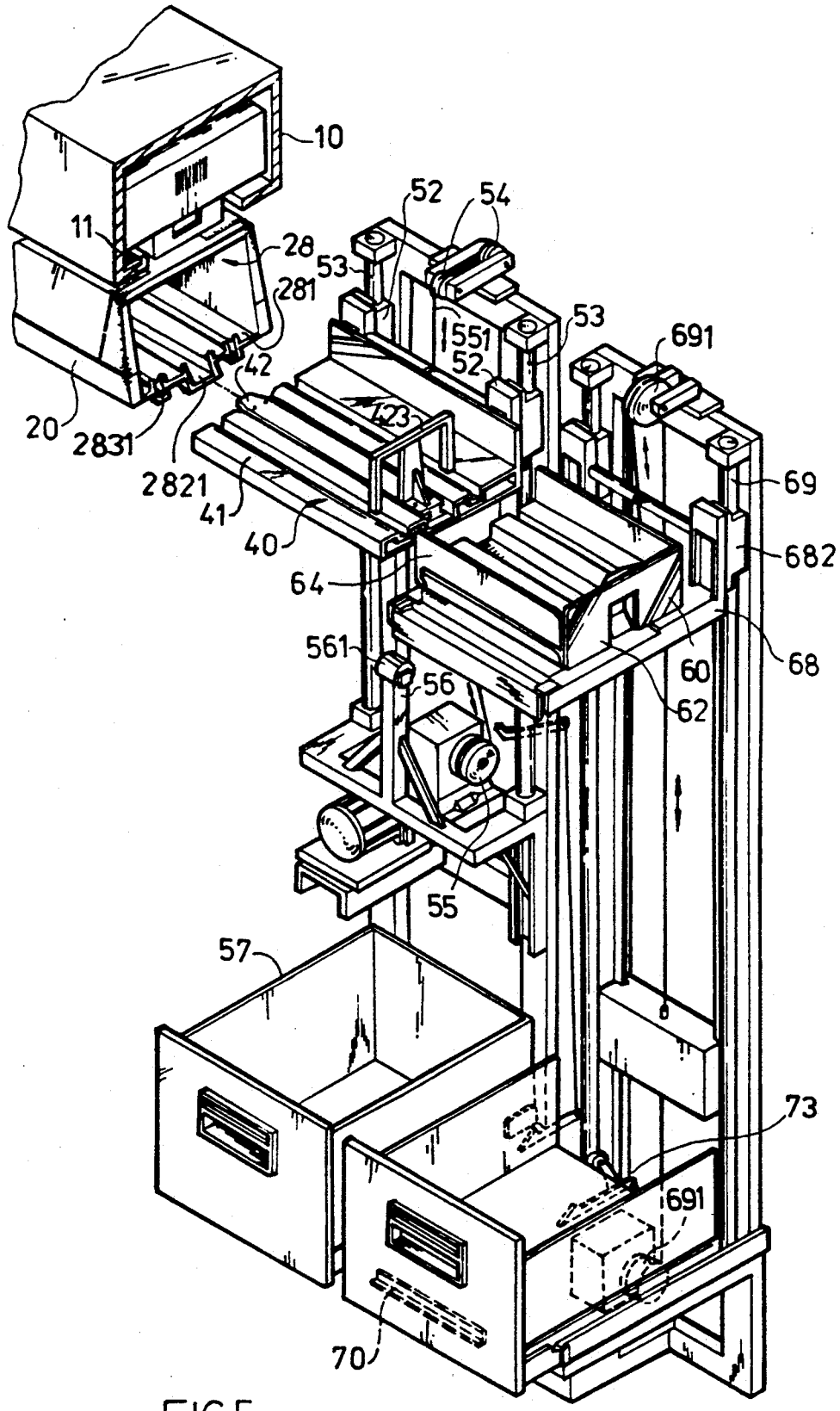
FIG. 5 is a perspective view of one embodiment of an apparatus for receiving and delivering articles according to the invention.
Figure 6:
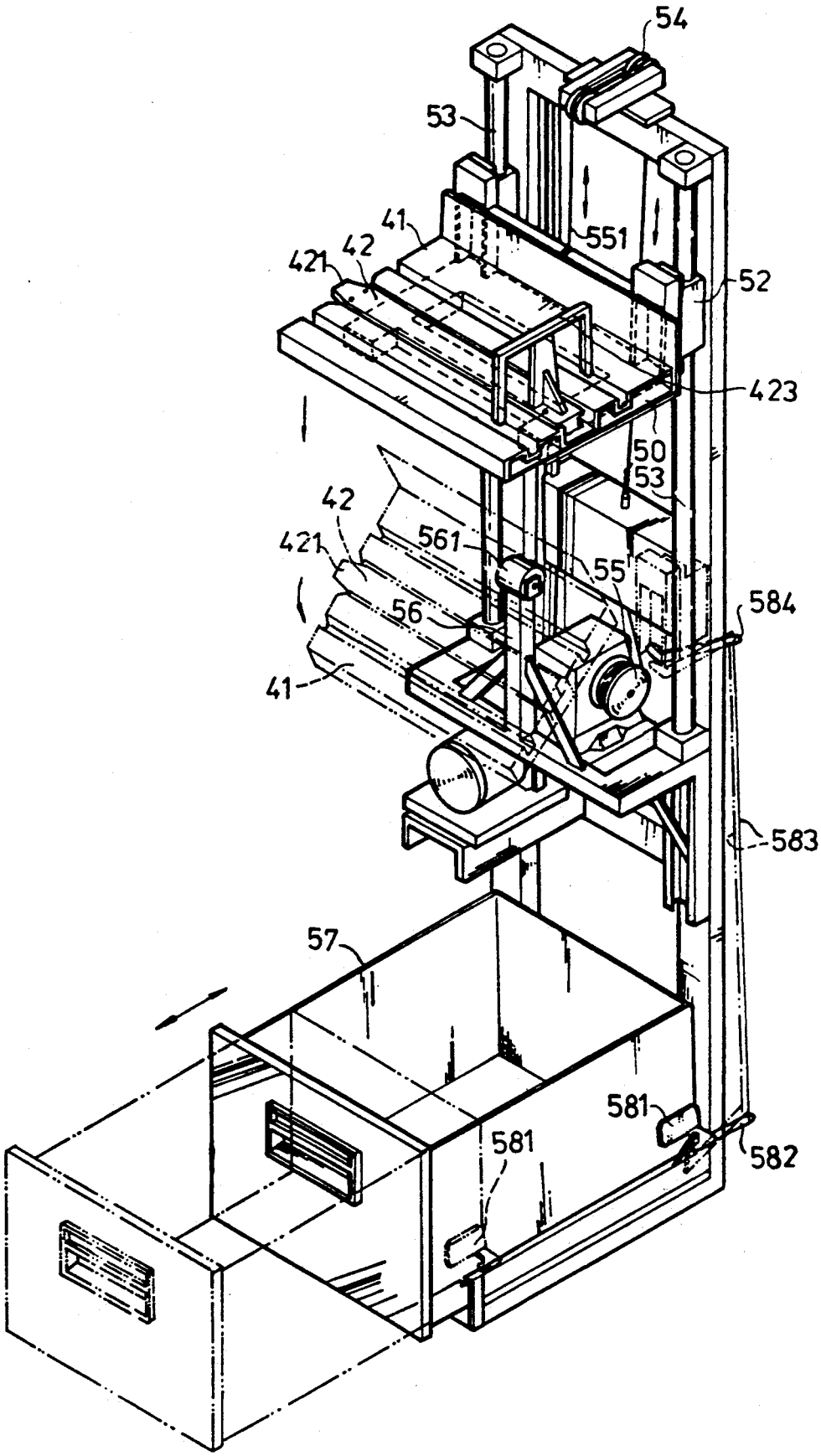
FIG. 6 is a perspective view of the receiving station forming part of the apparatus shown in FIG. 5.
Figure 7:
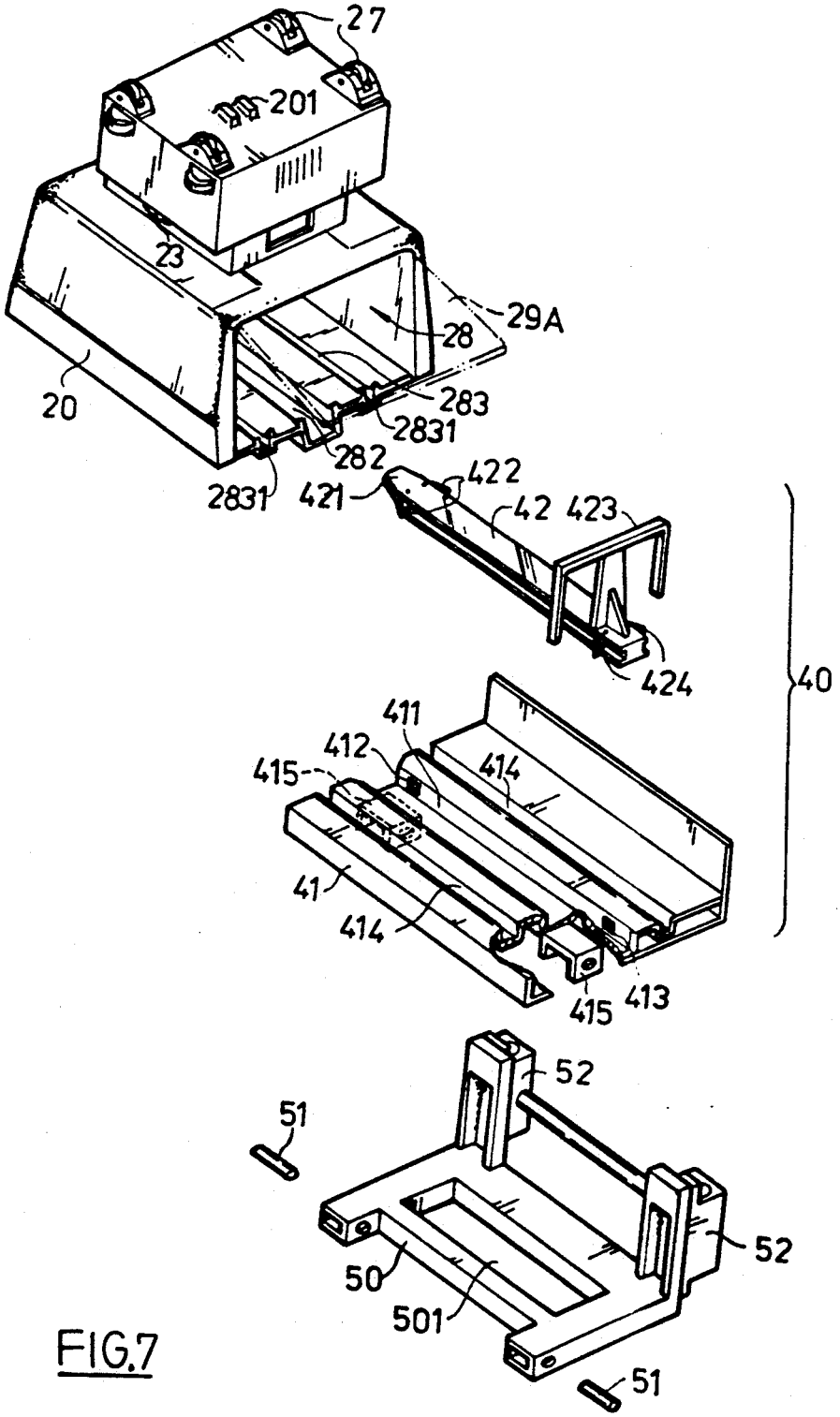
FIG. 7 is an exploded perspective view of the receiving apparatus of the receiving station shown in FIG. 6 and of a car adapted to co-operate therewith.

Articles stopped by the receiving apparatus 40 may be removed manually but it is preferred to mount the plate 41 on an elevator. As shown in FIGS. 5 to 7, the plate 41 is provided on its underneath surface with a pair of lugs 415 by means of which the plate is pivotally connected to a rectangular elevator frame 50 by means of pivot pins 51. A pair of mounting posts 52 extend vertically upwards from a side edge of the rectangular frame 50 and are mounted on respective vertical guide rods 53. The guide rods 53 are mounted at each end on a vertical elevator frame work 531 having a pair of guide pulleys 54 at its upper end. A wire or cable 551 is secured at one end to a counterweight guided in the elevator framework 531, passes over the pulleys 54 and is wound on a power-driven pulley 55 mounted on the frame 50 of controlling ascent and decent of said frame. A standard 56 projects upwardly from a horizontal plate secured to the elevator framework, said standard being provided at its upper end with a roller 561. When the frame 50 descends, the roller 561 passes through a central slot 501 in sid frame and engages the base plate 41 of the receiving apparatus 40 causing the plate 41 to pivot about the pins 51 to the position shown in chain-dotted lines in FIG. 7 in which articles on the plate are free to fall off said plate into a drawer 57 located below. The frame 50 with the receiving apparatus 40 is then returned to the position shown in full lines in FIG. 7.

The drawer 57 is retained in position by providing lugs 581 on its side walls which are engageable by locking components 582. The locking components 582 are connected by a cable 583 to a swinging mechanism 584 which is pivotally mounted on the elevator framework 531 below the roller 561. When the frame 50 descends, it engages the mechanism 584 causing it to pivot which in turn, via the cable 583, causes the locking components 582 to pivot clear of the lugs 581 thereby freeing the drawer 57 for removal. The drawer can simply be replaced by pushing it in, the lugs 581 depressing the locking components 582 as they move over them, said locking components then engaging behind the lugs 581 to hold the drawer in position until the locking components are again released by the action of the frame 50 on the mechanism 584.

Figures 11, 12:
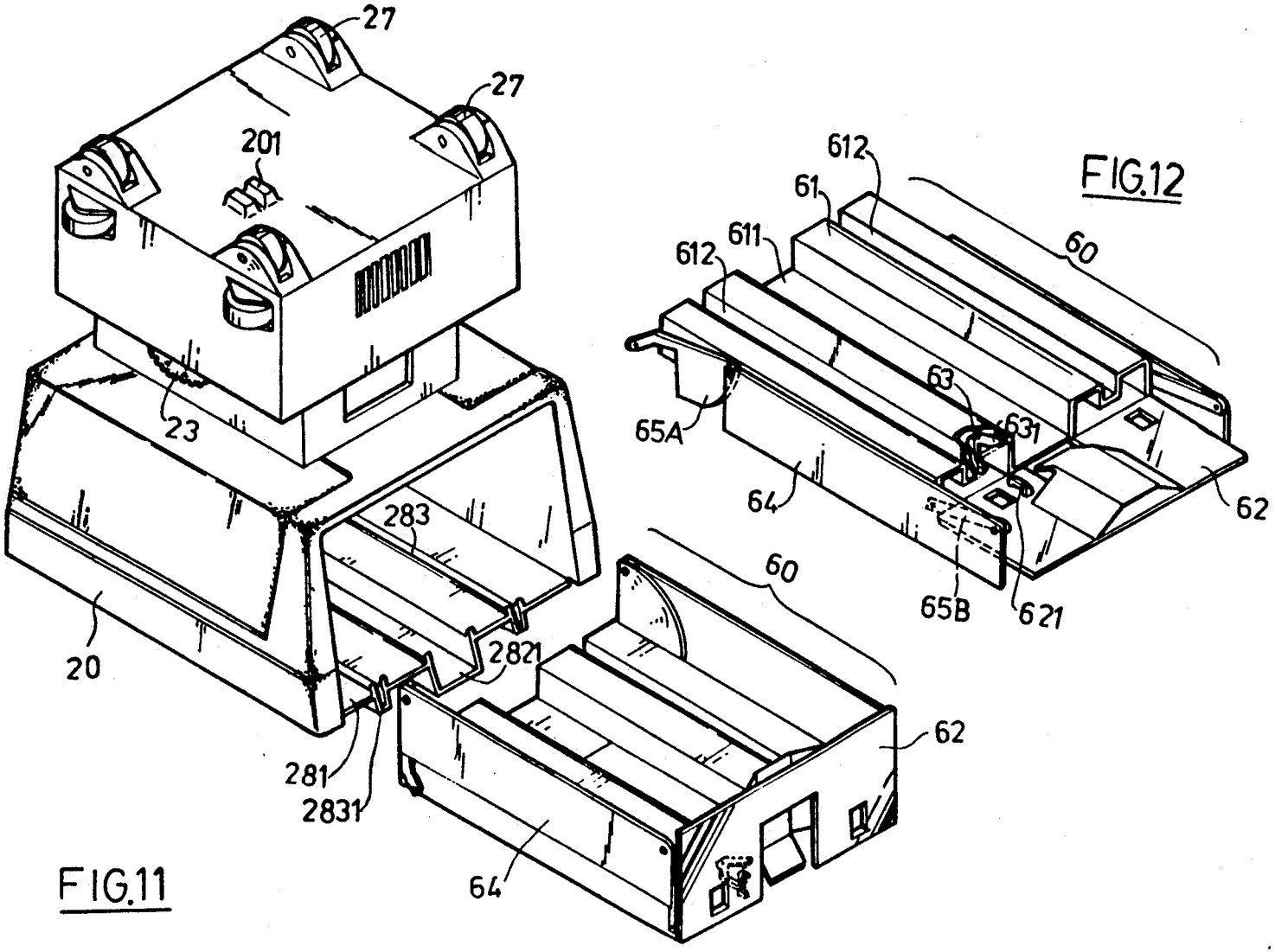
FIG. 11 is an exploded perspective view of the delivering apparatus of the delivering station shown in FIG. 10 and of a car adapted to co-operate therewith, components of said delivering apparatus being shown in one position.
FIG. 12 is an exploded perspective view of the delivering apparatus shown in FIG. 11 but showing components thereof in another position.
Figure 9:
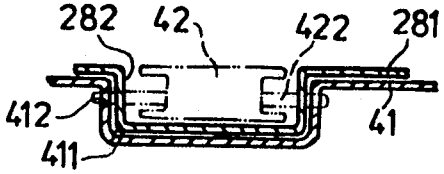
FIG. 9 is a vertical section through part of the base of the car and a plate of the receiving apparatus shown in FIG. 7 when the car is in the position shown in FIG. 8B.
Figure 13:
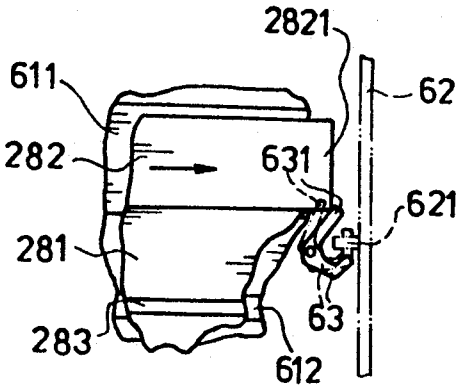
FIG. 13 is a plan view of part of one end of the delivering apparatus shown in FIGS. 11 and 12; and in the direction of the arrow.

The delivering apparatus 60 is illustrated in FIGS. 5 and 10 to 14 and comprises a base plate 61 provided with grooves 611 and 612 for receiving, respectively, the channel 282 and ribs 283 on the base plate 281 of the chamber 28. The plate 61 is located below the height of the plate 281 for permitting the channel 282 and ribs 283 to engage in the grooves 611 adn 612. A stopper plate 62 is pivoted to the rear end of the plate 61 and has a bracket 621 which is engageable by a hook 63 which is effective to retain the stopper plate 62 in an upright position. As shown in FIG. 13, the hook 63 has an operating arm 631 which extends into the groove 611 through a slot in the side wall thereof. As the car 20 passes through the delivering apparatus 60, the channel 282 will move along the central groove 611 until the leading end of the channel engages the operating arm 631. Further movement of the channel 282 along the groove 611 will move the arm 631 from the position shown in chain-dotted lines in FIG. 13 to the position shown in full lines in which the hook 63 is disengaged from the bracket 621. Further movement of the car 20 through the delivering apparatus will cause the leading end of the car to push down the stopper plate 62 so that the car will carry away from the apparatus 60 any articles placed therein.

The base plate 61 is preferably provided with side walls 64 to prevent article from falling off the sides of the plate. The side walls are pivotally connected to the base plate 61 by connecting links 65A and 65B connected at their lower ends to the base plate 61 and at their upper ends to the side walls 64. Springs 66 acting on the connecting links 65A and 65B serve to maintain the side walls normally in an extended vertical position as shown in FIG. 11. As the car 20 moves through the delivering apparatus 60, the leading end of the car will engage the side walls 64 and press them down to the position shown in FIG. 12 against the action of the springs 66. However, before this happens, the channel 282 and ribs 283 will enter the grooves 611 and 612 and any articles on the plate 61 will then be reliably retained by the base plate 281 and the side walls of the chamber 28. The stopper plate 62 will prevent said articles from being pushed off the plate 61 until the articles are almost wholly contained within the chamber 28.

Documents or other articles to be delivered can be placed manually on the plate 61. However, the delivering apparatus is preferably provided with a sliding board 67 on which the plate 61 is mounted. The front end of the board 67 is provided with a tongue 671 and the drawer is slidably mounted in a frame 68 which is provided at the rear with brackets 682 slidably mounted on vertical rods 69. The rods 69 are mounted on a vertical elevator framework in which a counterweight is located, the counterweight being connected to the frame 68 by a cable 692 which is secured at one end to the counterweight, passes over a pulley 691 at the upper end of the elevator framework and is secured at its other end to a rod extending between the brackets 682 in order to control ascent and descent of the frame 68.

Figure 14:
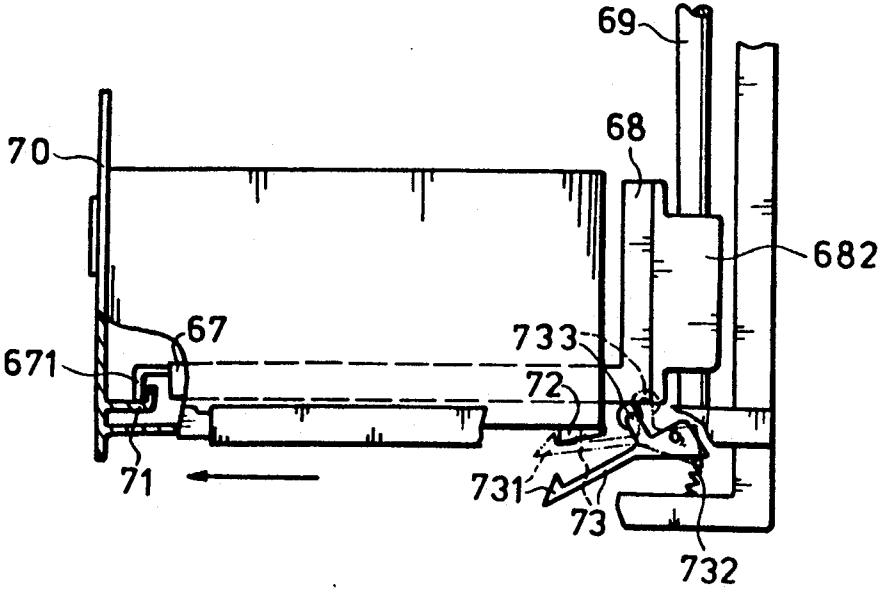

A drawer 70 is located at the lower end of the elevator framework, the front of the drawer having an L-sectioned strip 71 with which the tongue 671 on the board 67 is engageable, as shown in FIG. 14, when the frame 68 descends into the drawer 70. When the drawer 70 is pulled out, the sliding board 67 is pulled out with it to enable articles to be delivered to be put on the plate 61 of the delivering apparatus be a user.

In order to retain the drawer 70 in position, it is provided on its lower surface at the back with a tongue 72 which is engageable by a hook 731 of a locking component 73. This component is pivotally mounted on the elevator framework and is normally urged by a spring 732 into a position in which the hook 731 engages the tongue 72. A roller 733 is also provided on a further arm of the locking component 73 which is engageable by the frame 68 so that, in the lowered position of the frame, the locking component 73 is moved from the locking position shown in chain-dotted lines in FIG. 14 to the position shown in full lines in which the hook 731 is disengaged from the tongue 72 and the drawer 70 can be pulled out.

The above-described apparatus can be used in a conveyor system and ensures that cars mounted on the conveyor are not kept waiting at receiving and delivering stations so that jams and hold-ups to the system are avoided.

The whole conveyor system is powered by electricity for driving the motors of the cars for moving them along the conveyor as well as for opening and closing the doors. The rack and pinion engagement ensures that the cars are positively driven even on ascending and descending portions of the conveyor rail. Various control systems and/or micro computer systems may be provided for controlling the movement of the cars along the conveyor rail and for the receipt of documents at and collection of documents from the stations. The doors of the selected car will then be opened on approaching a given station to deposit or collect articles and then closed again after leaving that station.

The invention is not restricted to the above-described embodiment but variations and modifications may be made without departing from the scope of the invention. For example, the receiving station and delivering station need not be adjacent one another at the same location but may be spaced apart and situated at different locations.

I claim:

1. Apparatus for transferring articles comprising:

a generally horizontal track, at least one car arranged to travel along said track, said car having a base for supporting the articles to be delivered, said base having a channel longitudinally oriented with respect to said track, a receiving station located in the path of travel of said car along said track such that said car travels through the station, said receiving station comprising a plate with a groove for engageable contact with said channel, said plate located below said base, and a stopper having an upwardly projecting frame and a first pair and a second pair of locking components, said pairs being longitudinally spaced apart a distance greater than the longitudinal length of said base of said car, said stopper being located in said groove and retained therein by said locking componenets, said upwardly projecting frame being located above said base for retaining articles carried by the car, and said apparatus being arranged to automatically transfer the articles from the car to the station, such that during the car's travel through the station, the first pair of locking components are released by the channel of the base of the car travelling through said groove and subsequently re-engage before the second pair of locking componenets are released by said channel, such arrangement allowing the stopper to pass through the channel and receive said articles.

2. Apparatus according to claim 1, wherein said pairs of locking components are engaged in respective slots in the side walls of said groove in said plate of said receiving station.

3. Apparatus according to claim 1, wherein said plate of said receiving station is provided with a plurality of grooves for receiving a plurality of ribs provided on said base of said car.

4. Apparatus according to claim 1, wherein said plate of said receiving station is pivotally mounted on a frame which is mounted for vertical movement on an elevator framework whereby said plate can be raised into a first position in which said plate is engageable with said base of said car and lowered into a second position in which said plate is arranged to deposit articles thereon into a drawer or the like located below said plate.

5. Apparatus according to claim 4, wherein said elevator framework has mounted thereon a standard which is engageable with said plate as said plate is lowered into said second position so that said plate pivots and allows said articles thereon to slide off.

6. Apparatus according to claim 1, wherein said car is provided at its front and rear ends with respective doors, means being provided for opening said doors before said car enters said receiving station and for closing said doors after said car leaves said receiving station.

7. Apparatus according to claim 6, wherein each of said doors is pivotally mounted at the top of the respective end of said car.

8. Apparatus according to claim 1, wherein said car comprises an upper part arranged to travel on said track and housing drive means for said car, and a lower part comprising a chamber arranged to hold articles for delivery to said receiving station.

9. Apparatus according to claim 8, wherein said track is provided with a toothed rack and wherein said drive means of said car includes a pinion engageable with said rack of said track.

10. Apparatus according to claim 9, wherein said track has portions which are inclined to the horizontal, said portions being provided with a second toothed rack, and said drive means of said car includes a second pinion engageable with said second toothed rack.

11. Apparatus for transferring articles comprising:

a generally horizontal track, a least one car arranged to travel along said track, said car having a base for supporting the articles to be received, said base having a channel longitudinally oriented with respect to said track, said car having a leading end in the direction of its travel, a delivering station located in the path of travel of said car along said track such that said car travels through the station, and said delivering station comprising a plate with a groove for engageable contact with said channel, said plate being located below said base, and a stopper member pivotally mounted at the rear end of said plate for movement between a normally substantially vertical position and a substantially horizontal position, said apparatus being arranged to automatically transfer the articles from the station to the car, such that during the car's travel through the station, said stopper member being in said vertical position to hold said articles on said plate until said car's leading end makes contact with said stopper member to force it to said horizontal position after said articles have been picked up by said base of the car.

12. Apparatus according to claim 11, wherein said stopper member is normally held in said substantially vertical position by a hook which is arranged to be disengaged by said channel on said base of said car as said channel travels along said groove in said plate of said delivering station.

13. Apparatus according to claim 11, wherein said plate is provided with side walls which are pivotally connected to said plate by links and which are arranged to be depressed in a substantially vertical direction by said base of said car during passage of said car through said delivering station.

14. Apparatus according to claim 11, wherein said plate of said delivering station is mounted for vertical movement on an elevator framework whereby said plate can be raised into a first position in which it is engageable with said base of said car and lowered into a second position in which it is arranged to receive articles to be delivered to said car when said plate is in said first position.

15. Apparatus according to claim 14, wherein said plate is provided with a board slidably mounted therein, said board being normally retained substantially within said plate by locking means arranged to be released when said plate is in said second position whereby said board is slid at least partially out of said plate.

16. Apparatus according to claim 14, wherein a drawer is provided substantially at the base of said elevator framework, said drawer being adapted to receive said plate in said second position.

17. Apparatus according to claim 11, wherein said car is provided at its front and rear ends with respective doors, means being provided for opening said doors before said car enters said delivering station and for closing said doors after said car leaves said delivery station.

18. Apparatus according to claim 17, wherein each of said doors is pivotally mounted at the top of the respective end of said car.

19. Apparatus according to claim 11, wherein said car comprises an upper part arranged to travel on said track and housing drive means for said car, and a lower part comprising a chamber arranged to hold articles for collection from said delivering station.

20. Apparatus according to claim 19, wherein said track is provided with a toothed rack and wherein said drive means of said car includes a pinion engageable with said rack of said track.

21. Appartus according to claim 20, wherein said track has portions which are inclined to the horizontal, said portions being provided with a second toothed rack, and said drive means of said car includes a second pinion engageable with said second toothed rack.

* * * * *